US006209459B1

(12) United States Patent
Kaufman et al.

(10) Patent No.: US 6,209,459 B1
(45) Date of Patent: Apr. 3, 2001

(54) METHOD FOR ETCHING CHARACTERS ON BULLETS AND BULLETS MADE BY THE METHOD

(75) Inventors: Francis J. Kaufman, Portland, OR (US); Jerry L. Hill, Clarkson, WA (US); Steven R. Moore, Lewiston, ID (US); Dennis K. Conley, Moscow, ID (US); Kenneth L. Alexander, Lewiston, ID (US)

(73) Assignee: Blount, Inc., Montgomery, AL (US)

( * ) Notice: Subject to any disclaimer, the term of this patent is extended or adjusted under 35 U.S.C. 154(b) by 0 days.

(21) Appl. No.: 09/008,230

(22) Filed: Jan. 16, 1998

(51) Int. Cl.[7] ..... F42B 5/03; F42B 12/80

(52) U.S. Cl. ..... 102/439; 102/501; 102/511; 102/514; 29/1.23; 86/1.1

(58) Field of Search ..... 102/293, 430, 102/439, 4 B, 501, 511, 514–516; 29/1.2–1.23; 86/1.1, 19

(56) References Cited

U.S. PATENT DOCUMENTS

| | | | | |
|---|---|---|---|---|
| 1,275,669 | | 8/1918 | Forbes . | |
| 1,632,156 | | 6/1927 | Wiley . | |
| 1,650,908 | | 11/1927 | Ramsey . | |
| 1,678,162 | * | 7/1928 | Pedusen | 86/19 |
| 1,887,324 | | 11/1932 | Pocoroba . | |
| 4,150,624 | | 4/1979 | Hammond . | |
| 4,454,175 | * | 6/1984 | Martin | 102/511 |
| 5,400,716 | * | 3/1995 | Mayer | 102/517 |
| 5,485,789 | | 1/1996 | Collier . | |
| 5,528,990 | * | 6/1996 | Corzine et al. | 102/511 |
| 5,698,816 | * | 12/1997 | Rexby | 102/516 |

FOREIGN PATENT DOCUMENTS

| | | | | |
|---|---|---|---|---|
| 499832 | * | 8/1992 | (EP) | 102/511 |
| 16922 | * | 5/1905 | (GB) | 102/530 |

* cited by examiner

*Primary Examiner*—Harold J. Tudor
(74) *Attorney, Agent, or Firm*—Klarquist Sparkman Campbell Leigh & Whinston, LLP

(57) ABSTRACT

A method of marking bullets and bullets marked by the method are described. In one embodiment, the method comprises coating the bullet of a cartridge with at least one coating material whose surface appearance contrasts with the surface appearance of the underlying bullet material. Characters are then selectively etched in, and generally substantially through, the coating, such as molybdenum disulfide. The characters are easily and quickly recognized because of the contrast between the surface appearances of the coating and that of the underlying material. The characters typically, but not necessarily, indicate characteristics of the bullet, such as bullet weight and design features.

28 Claims, 1 Drawing Sheet

METHOD FOR ETCHING CHARACTERS ON BULLETS AND BULLETS MADE BY THE METHOD

FIELD OF THE INVENTION

The present invention concerns a method for marking a bullet with characters and bullets marked according to the method.

BACKGROUND OF THE INVENTION

Ammunition bullets are characterized by, among other things, caliber and weight. Caliber represents the diameter of the bullet, while weight represents the mass of the bullet. Bullet mass is commonly designated in terms of avoirdupois grain weight throughout the United States.

The flight trajectory and terminal performance of a bullet depend heavily upon the caliber and the weight of the bullet. For example, with other ballistic variables being equivalent, a bullet with a heavier weight sustains its flight velocity better than a lighter weight bullet. The heavy weight bullet, usually launched at a lower initial velocity, drops further from the line of sight than a lighter bullet when fired at the same target. This requires aiming adjustments by the shooter when using ammunition with different weight bullets.

Heavy weight bullets typically penetrate deeper upon terminal impact than lighter bullets, which partially compensates for their lower velocities. Other technical advantages and disadvantages of light or heavy bullets are well known to experienced marksmen.

Marksmen therefore want to know the weight of the bullets in the cartridges they intend to shoot. Differences in bullet weights often are not apparent simply by viewing or handling loaded cartridges. Bullets weights for a common cartridge in its various loadings might vary between 100 and 125 grains. A 25 grain (0.057 ounce) difference is not substantial enough to allow the shooter to quickly or reliably differentiate between two cartridges while holding one of each bullet weight type. Visual determination of bullet weight is not practical because a significant portion of a bullet in a cartridge is obscured by the cartridge casing. Other important bullet characteristics such as construction materials and design features also may not be visibly apparent after the bullet is assembled into a finished cartridge.

Most manufacturers mark ammunition packaging with some indication of bullet weight and perhaps other bullet characteristics. However, packaging markings are ineffective once the bullet has been removed from the package. Moreover, spent casings of cartridges often are reloaded with new cartridge components and the resulting reloads do not necessarily incorporate the proper information to identify the bullet loaded therein.

Some inventions are known whereby bullets convey information. Marking bullets with a system of bands or grooves to indicate bullet characteristics is described in, for example, U.S. Pat. Nos. 1,632,156 and 1,650,908. But, in each situation these marking schemes require marksmen to memorize several different configurations of bands and the corresponding bullet characteristics. Further, such marking systems are not generally known by the shooting public.

U.S. Pat. Nos. 1,887,324, 4,150,624 and 5,485,789 describe bullets having identifiers embedded therein. These inventions offer no help to marksmen because the information is stored inside the bullet and is not visible. Such information generally is of a type not intended for marksmen anyway as such information is usually provided for forensic purposes.

SUMMARY OF THE INVENTION

Based on the above, it is apparent that a need exists for a method for marking bullets so that marksmen can quickly and reliably identify the bullet weight and type when loaded in a cartridge. The present invention addresses this need.

One embodiment of the present method for etching a character or characters onto a bullet comprises first providing a bullet having a coating on at least a portion thereof. The coating typically has a surface appearance that contrasts with a portion of the bullet that underlies the coating. One or more characters are then etched through the coating. For example, a character or characters may be etched through the coating to reveal the underlying bullet substratum.

The etching step can be performed mechanically, chemically or with a localized energy source such as an electron beam or a laser. Examples of lasers having sufficient power for commercial production of large quantities of etched bullets according to the present method include, without limitation, YAG and $CO_2$ lasers. Alternatively, the etching step can be performed mechanically, such as by applying an abrasive to the coating, or by stamping a dot matrix pattern through the coating to form a character or characters.

Functionally, the coating acts as a contrast agent, but it also can have other desired technical functions when applied to a bullet, such as acting as a lubricant. Coatings currently considered useful for practicing the present method are selected from the group consisting of molybdenum disulfide, tin, copper, metallic oxides, zinc, nickel, silicon, organic resins, paints, stains, aluminum, gold, silver, and mixtures and alloys thereof. Molybdenum disulfide is a currently preferred coating.

The present invention is particularly useful for etching bullet weight and type numerals onto a bullet. The method involves providing a cartridge comprising a bullet and a casing. The outer surface of the bullet is then coated with molybdenum disulfide. A laser is then focused on the coating in a desired pattern to remove a portion of the coating corresponding to the pattern. Contrast between the coating and the exposed substratum of the bullet helps marksmen see the bullet weight and type characters. These characters are located on the bullet in a position that they are easily seen even after the bullet is loaded in the cartridge casing.

The present invention also is directed to bullets etched by the method briefly described above. One embodiment of an etched bullet comprises a core and an jacket. A coating is applied over at least a portion of the plating, and characters are etched through the coating to reveal an outer surface of the plating.

DESCRIPTION OF THE PREFERRED EMBODIMENTS

A. Definitions

The following definitions are provided solely for the convenience of the reader. The definitions should not be construed to limit the terms defined to a scope narrower than would be known to a person of ordinary skill in the art.

Ammunition: Multiple cartridge for firearms, guns or cannons.

Cartridge: A single, complete, self-contained unit for use in firearms. It incorporates a shellcase, bullet, propellant powder and primer.

Bullet: The projectile intended to be expelled from a firearm upon discharge.

Loading: The particular type, size quantity, or combination of cartridge components assembled for a specific purpose.

Propellant: The cartridge energy source. Also referred to as "gun powder" or "powder."

Primer: The cartridge ignition device, usually activated by firearm imposed mechanical Ipercussion or electrical discharge.

Shellcase: A generally tubular container intended to contain and orient the other firearm cartridge components. Also referred to as "case" and "casing."

B. Bullet Composition and Structure

Figure 1:
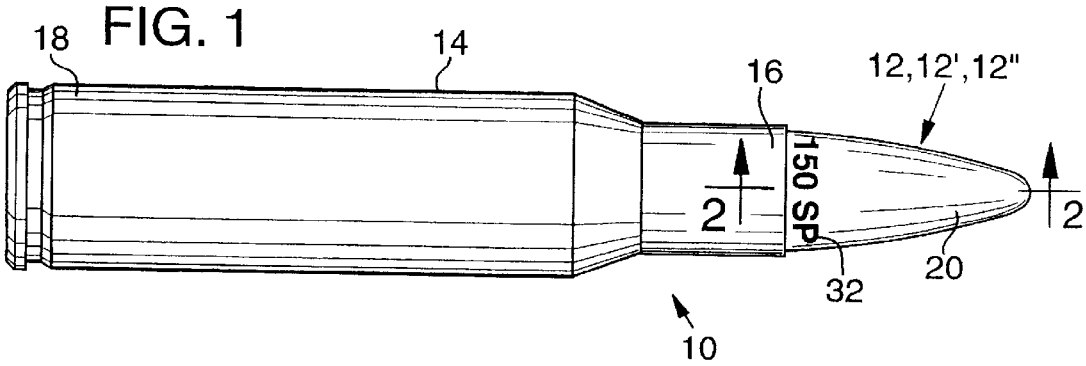
FIG. 1 is a side view of an etched bullet made in accordance with the present invention.

Referring to FIG. 1, cartridge 10 consists of a bullet 12 (FIG. 2), 12' (FIG. 3) or 12" (FIG. 4) and a casing 14. Elongated casing 14 has an open end 16 and a closed end 18. Open end 16 is shaped to receive bullet 12, 12' or 12". Visible ogive portion 20 of bullet 12, 12' or 12" ("ogive" refers to the cylindrical, tapered or curved, forward part of the bullet) extends outwardly from casing 14.

Bullets can have various compositions, and can be jacketed with various materials, with copper-alloy jacketed bullets being but one example. Bullets also can be formed from a solid piece of material, with copper being one example. The present invention can be practiced with all such bullets, as will be appreciated by a person of ordinary skill in the art.

Figure 2:
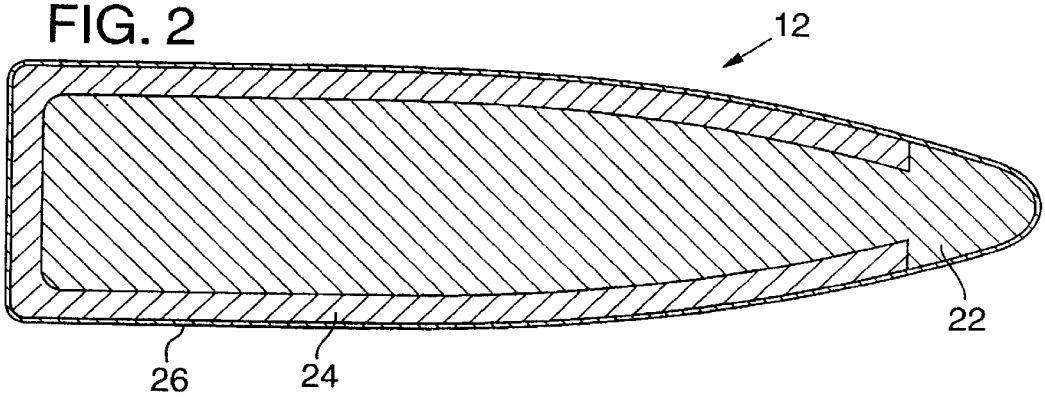
FIG. 2 is an enlarged sectional view of the embodiment of FIG. 1, taken along line 2—2.

Solely to illustrate the invention, FIG. 2 shows an embodiment of a bullet 12 that can be etched in accordance with the present invention. Bullet 12 includes a core 22, preferably a lead-alloy, a jacket 24, and a coating 26. Jacket 24 typically comprises a metal or alloy, such as copper, brass, nickel or zinc. Jacket 24 may substantially completely or completely surround the core 22.

Figure 3:
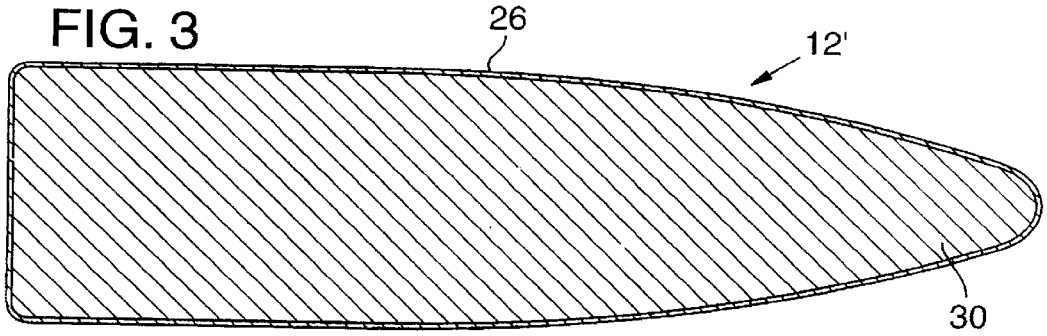
FIG. 3 is an enlarged sectional view of an alternative embodiment of the bullet illustrated in FIG. 1.

FIG. 3 illustrates bullet 12'. Bullet 12' consists entirely of lead, copper, brass or other metallic alloys or compositions used for making bullets. FIG. 3 also shows that the bullet 12' includes a coating 26.

Figure 4:
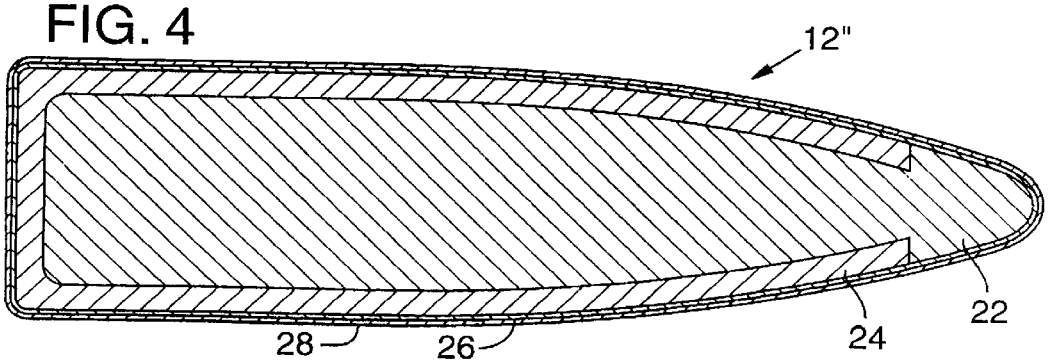
FIG. 4 is an enlarged sectional view of an alternative embodiment of the bullet illustrated in FIG. 1.

FIG. 4 illustrates bullet 12". Bullet 12" includes a core 22, such as a lead-alloy core, and a jacket 24. FIG. 4 also shows that the bullet 12" can include plural coatings, such as coatings 26 and 28.

Usually, but not necessarily, bullets 12, 12' or 12" are marked with characters rather than the casing 14. One reason for this is that casing 14 may be reloaded with a bullet having a different weight or type than that of the original, which might render inaccurate the initial information stated on casing 14.

C. Coatings and Methods of Coating Bullets

A first coating 26 is disposed over at least a portion of bullet 12 or 12'. FIG. 4 illustrates that bullet 12" can have plural coatings, with the illustrated embodiment having an outside coating 26 and an inside coating 28. In a preferred embodiment, an underlying portion of bullet 12 or 12" that underlies coating 26 or 28 is a portion of jacket 24. One consideration for selecting a material for coating 26 and 28 is how well it contrasts with jacket 24. A currently preferred embodiment of bullet 12 uses a dark coating 26, which contrasts well with the metallic color of the copper or brass jacket 24.

Coating 26 also preferably functions as a lubricant. A lubricant on bullet 12, 12' or 12" decreases wear to the bore of the gun barrel. This increases the useful lifetime of the barrel.

In a preferred embodiment, coating 26 or coating 28 comprises molybdenum disulfide ($MoS_2$). Molybdenum disulfide is used because (1) it is dark in color and (2) it functions as a lubricant. Alternatively, the coating 26 or 28 may comprise tin, which also is a lubricant. In yet another embodiment, coating 26 or 28 consists of a metallic oxide, such as copper oxide (CuO). In still another embodiment, jacket 24 is steel, and coating 26 or 28 is copper. Thus, without limitation, coatings 26 and 28 currently considered useful for practicing the present method may be selected, without limitation, from the group consisting of molybdenum disulfide, tin, copper, metallic oxides, zinc, nickel, silicon, organic resins, paints, stains, aluminum, gold, silver, and mixtures and alloys thereof.

If used, coating 26 is applied over jacket 24, or solid bullet material 30, or second coating 28, in a layer sufficiently thin so that it does not substantially alter the aerodynamic, mass, mechanical or other desired characteristics of bullet 12, 12' or 12". The thickness of coating 26 and 28 typically ranges between an immeasurable thickness where the coating material penetrates the surface of the bullet 12, 12' or 12" to a thickness of 0.001 inch. However, coatings 26 and 28 may be thicker if the mass, mechanical and aerodynamic properties of coating 26 are taken into account when it is applied.

A pattern 32 is etched onto the visible portion 20 of bullet 12, 12' or 12" and extends sufficiently through coating 26 to reveal jacket 24, or bullet material 30, or second coating 28. In a preferred embodiment shown in FIG. 1, etched pattern 32 states the weight in grains (i.e., 150) of the bullet and the type of bullet (i.e., Spitzer), (SP). In addition to numerals and letters, other markings such as trademarks, logos, symbols, designs, indicia, statements concerning other characteristics of the bullet, etc., may be etched onto bullets. Numerals, words, trademarks, logos, symbols, patterns, designs, indicia, statements concerning other characteristics of the bullet, and all other manner of markings, are collectively referred to herein as characters. Individual characters of pattern 32 etched onto bullets are easily read because of the contrast between the surface appearance of the coating 26 and that of the substratum jacket 24, the contrast between coatings 26 and bullet material 30, or the contrast between coating 26 and coating 28.

The method for manufacturing bullets, including the method for applying the jacket 24 around the core 22, is known to those of ordinary skill in the ammunition industry. Any previously known method for manufacturing bullets to be marked according to the present invention is acceptable. As stated above, the entire body of the bullet 12' may consist of a single material, such as copper or lead alloy bullet materials 30. In another method, jacket 24 is around the core 22.

Once the bullet 12 or 12' is manufactured, it is then coated with coating 26. In a preferred embodiment, bullet 12 with an electroplated jacket 24 is coated with $MoS_2$, as stated above. The currently preferred method for coating articles with $MoS_2$ is described in U.S. patent application Ser. No. 60/049,692, which is incorporated herein by reference.

Alternatively, bullet 12, 12' or 12" may be coated with an oxide by oxidizing those materials forming the external surface of the bullet, such as jacket 24, solid core 30, or coating 28. The oxide coating is produced by exposing bullet 12, 12' or 12" to an oxidizing agent for a sufficient period to oxidize the surface of the bullets. The type of oxidizing agents and time of exposure to these agents vary for given jacket materials. A system is used that provides adequate contrast between the oxide finish and the underlying jacket.

In another embodiment, one metal or alloy core 30 or jacket 24 may be coated with another metal or metal alloy coating 26 or 28. For example, copper may be coated over steel or tin over copper. This may be accomplished by electroplating a thin layer of metal on the underlying jacket, or peening powdered metal into the surface of the underlying jacket.

An additional embodiment (FIG. 4) combines one (or more) thin inside coating layers 28 of metals superposed over jacket 24 or core 30 and possibly an outer layer 26 of a lubricant coating. With the layers 26 and 28 being in visual contrast with one another, different colors can be exposed by varying the depths of coating removal. For example, a copper jacket can have a thin nickel coating with a black $MoS_2$ coating over the nickel.

D. Etching Bullets

After bullet 12, 12' or 12" is coated, coating 26 and/or 28 is then etched. The etching preferably extends through the coating 26 but not substantially into the jacket 24 or base material 30. Any etching method or device that will etch the desired patterns with the requisite accuracy and predictability to form legible characters into or through the coating 26 and/or 28 can be used to practice the present invention. For example, etching can be accomplished using a chemical etchant, such as acids, alkalis, or organic solvents, dependent on the coating material 26 and/or 28 to be etched. Another method for etching would be to use an electron beam device. The etching step also can be accomplished using an abrasive media device or cutter designed for etching. All etching devices are collectively referred to herein as an "etcher" or as "etchers". Etching also can be accomplished using any combination of these methods.

A preferred etcher is a laser in which energy is focused on, for example, bullet 12, 12' or 12" in a pattern designed to melt, oxidize, vaporize, or displace the coating 26 and/or 28 in its path corresponding to a desired pattern 32. Any of several well-known types of lasers can perform the laser etching operation. For mass production, the etching step should be performed quickly. One factor to consider for determining whether a particular laser is appropriate for etching bullets is the power required for a desired etched bullet output. It currently is known that a YAG or $CO_2$ laser would be useful for commercial production of etched bullets because of their high energy output.

The time necessary to etch a bullet varies depending on a number of factors, including the size and intricacy of the pattern being etched, the thickness of the coating 26 or 28, the location of the etched pattern on the bullet and the laser used. Typically, however, the etching time is between a fraction of a second and three seconds. These etching times are short enough to keep pace with the rest of the production steps used for manufacturing bullets.

Any of several methods may be used to position bullets to be etched by an etcher. In a preferred laser-etching embodiment, bullets, 12, 12' or 12" are placed in jigs arranged on a plate under the laser. This method allows a large quantity of bullets 12, 12' or 12" to be processed quickly and inexpensively. In an alternative embodiment, bullets 12, 12' or 12" are placed individually into a rotating jig. The jig then turns bullets 12, 12' or 12" as the laser etches them. The rotating jig allows the laser to etch around the entire circumference of bullets 12, 12' or 12", while the plate may allow the laser to etch only limited areas of bullets 12, 12' or 12".

In another embodiment for etching bullets using an etcher according to the present invention, coating 26 and/or 28 is glass bead or sand blasted away to reveal an underlying portion of the bullet 12, 12' or 12". Such abrasive techniques for etching articles other than bullets are known. One such method is practiced commercially by Marble Marking Products of Pittsburgh, Pa.

Still another alternative etching method comprises stamping dots into the coating 26 and/or 28. In this embodiment, the stamp penetrates through coating 26 and/or 28 to reveal the underlying material. A dot matrix system, as incorporated on some printers, form the desired insignia. Suitable stamping methods also are known, such as the processes practiced by Microdot Marking Systems of Cleveland, Ohio.

In another embodiment, neither bullet 12, 12' or 12" are coated with coating 26. In this embodiment a pattern is etched directly into bullet 12, 12' or 12" to form a recognizable character or characters, such as the characters described above, particularly bullet weight. The same types of etching methods may be used for this embodiment as described for the previous embodiments.

Although the invention is described herein with reference to certain preferred embodiments, one of ordinary skill in the art will appreciate that other applications may be substituted for those set forth herein without departing from the spirit and scope of the invention.

We claim:

1. A method of etching a character or characters onto a bullet, comprising:

providing a bullet having a coating on at least a portion thereof, the coating selected from the group consisting of molybdenum disulfide, tin, copper, metallic oxides, zinc, nickel, silicon, organic resins, aluminum, gold, silver, and mixtures and alloys thereof, the coating contrasting with bullet material underlying the coating; and laser etching one or more characters comprises bullet weight characters through the coating at a portion of the bullet which is visible when the bullet is coupled to a cartridge casing.

2. The method according to claim 1 where etching comprises etching a pattern through the coating to reveal the underlying bullet material so that contrast between the underlying bullet material and the coating defines the one or more characters.

3. The method of claim 1 wherein the laser etching is performed by a YAG or $CO_2$ laser.

4. The method of claim 1 wherein the coating comprises a metallic oxide.

5. The method of claim 1 wherein the coating comprises molybdenum disulfide.

6. A method of etching a character or characters onto a bullet, comprising:

applying at least one coating to at least a portion of a bullet, the at least one coating selected from the group consisting of molybdenum disulfide, tin, copper, metallic oxides, zinc, nickel, silicon, organic resins, aluminum, gold, silver, and mixtures and alloys thereof, the at least one coating contrasting with other bullet material underlying the at least one coating; and etching a pattern through at least one coating using a laser, thereby forming one or more characters on a portion of the bullet which is visible when the bullet is coupled to a cartridge casing.

7. The method of claim 6 wherein the at least one coating comprises a metallic oxide.

8. The method of claim 6 wherein the at least one coating is molybdenum disulfide.

9. A method of etching weight numerals onto a portion of a bullet, which is visible when the bullet is coupled to a cartridge casing comprising:

providing a bullet;

coating an outer surface of the bullet with a molybdenum disulfide coating; and applying a laser to the coating in a pattern, thereby selectively removing the coating from the outer surface of the bullet corresponding to a desired pattern so that contrast between the coating and a portion of the bullet underlying the coating forms bullet weight numerals.

10. The method according to claim 9 where the bullet comprises a core and a jacket.

11. The method according to claim 9 where the bullet comprises a one-piece solid bullet.

12. A cartridge, comprising:

a bullet; a casing; coupled to said casing a coating covering at least a portion of the bullet, the coating selected from the group consisting of molybdenum disulfide, tin, copper, metallic oxides, zinc, nickel, silicon, organic resins, aluminum, gold, silver, and mixtures and alloys thereof; the coating contrasting in appearance with a surface appearance of a portion of the bullet that underlies the coating; and a laser etched pattern extending through the coating to form one or more characters on a visible portion of the bullet.

13. The cartridge of claim 12 wherein the coating covers substantially completely a portion of the bullet not housed inside the casing.

14. The cartridge of claim 12, wherein the bullet further comprises two or more coatings contrasting in appearance with each other and also contrasting with the surface appearance of the bullet that underlies the coatings, and wherein the etched pattern extends through at least one of the coatings to form two or more characters with contrasting colors.

15. The cartridge of claim 12 wherein the bullet comprises:

a core; and an electroplated jacket disposed around the core, the plating contrasting with the coating, the etched pattern extending through the coating to reveal an outer surface of the plating.

16. The cartridge of claim 12 wherein the one or more characters further comprise trademarks.

17. The cartridge of claim 12 wherein the one or more characters are numerals stating the weight of the bullet.

18. The cartridge of claim 12 wherein the coating comprises a metallic oxide.

19. The cartridge of claim 12 wherein the coating comprises molybdenum disulfide.

20. The cartridge of claim 12 wherein the coating is tin.

21. laser etched bullet, comprising:

a bullet;

a coating disposed over and contrasting with the bullet, the coating selected from the group consisting of molybdenum disulfide, tin, copper, metallic oxides, zinc, nickel, silicon, organic resins, aluminum, gold, silver, and mixtures and alloys thereof; and a laser-etched pattern extending through the coating to reveal an underlying bullet portion that underlies and contrasts with the coating, the pattern forming one or more characters on a portion of the bullet which is visible when the bullet is coupled to a cartridge casing.

22. The bullet of claim 21 wherein the bullet comprises:

a core; and an electroplated jacket disposed around the core, the plating having an appearance that contrasts with a surface appearance of the coating, and wherein the etched pattern reveals an outer surface of the plating.

23. The bullet of claim 21 wherein the one or more characters are numerals stating the weight of the bullet.

24. The bullet of claim 21 wherein the coating is a metallic oxide.

25. The bullet of claim 21 wherein the coating is molybdenum disulfide.

26. The bullet of claim 21 wherein the coating is tin.

27. The bullet of claims 21 wherein the jacket is steel and the coating is copper or copper alloy.

28. An etched cartridge, comprising:

a casing;

a bullet housed by the casing, the bullet having an electroplated jacket over substantially an entire outer surface of the bullet;

a coating disposed over at least a portion of the plating, the coating being selected from the group consisting of molybdenum disulfide, tin, metallic oxides, zinc, nickel, silicon, organic resins, aluminum, gold, silver, and mixtures and alloys thereof, and having a surface appearance that contrasts with a surface appearance of the plating; and a laser etched pattern extending through the coating to reveal an underlying plating portion that underlies the coating, the pattern defining a numeral or numerals corresponding to the weight of the bullet which is visible when the bullet on a visible portion of the bullet.

* * * * *